US005382945A

United States Patent [19]

Novak

[11] Patent Number: 5,382,945

[45] Date of Patent: Jan. 17, 1995

[54] MAIL SLOT ALARM

[76] Inventor: Peter J. Novak, 344 Rural Ave., Chester, Pa. 19013

[21] Appl. No.: 9,329

[22] Filed: Jan. 26, 1993

[51] Int. Cl.[6] ..... G08B 21/00

[52] U.S. Cl. ..... 340/569; 232/35; 200/61.63

[58] Field of Search ..... 340/569; 232/35, 36, 232/37; 200/61.63

[56] References Cited

U.S. PATENT DOCUMENTS

| | | | |
|---|---|---|---|
| 602,997 | 4/1898 | Nelson | 232/36 |
| 764,233 | 7/1904 | Field | 232/36 |
| 3,009,139 | 11/1961 | Hill, Jr. | 340/569 |
| 3,222,665 | 12/1965 | Tracy | 340/569 |

*Primary Examiner*—Glen Swann
*Attorney, Agent, or Firm*—Robert S. Lipton

[57] ABSTRACT

An alarm apparatus immediately alerts mail recipients of postal deliveries made through a mail slot opening. The device is mounted adjacent the mail slot and has an activation lever, the distal end of which is in contact with the hinged, swinging door of the mail slot, and the proximal end of which has a contact switch retention means. As the door is opened, the activation lever rotates causing the retention means to release the contact switch resulting in the completion of a circuit and the sounding of an alarm. The alarm may be a buzzer, beeper, radio or other suitable means of producing an audible alert which can be immediately detected. In another embodiment of the invention, completion of the circuit can activate a light for the hearing impaired. In still another embodiment of the invention, the subject device can be further adapted to trigger the activation of alarms at remote locations.

3 Claims, 1 Drawing Sheet

MAIL SLOT ALARM

BACKGROUND OF THE INVENTION

The subject invention is directed to an alarm apparatus for alerting mail recipients of postal deliveries through mail slot openings such as those found in or around front doors and entry-ways. The advantages associated with such a device will be readily apparent to those who use it.

Specifically, installation of such a device will obviate the necessity for repetitive visual inspection of the receptacle, a task that is commonly performed in an effort to determine whether daily mail has arrived. Such inspections are considered burdensome by many, particularly to those who must travel up and down stairs to see if an important letter or package has been delivered. More often than not, disappointment and frustration are experienced when a mail carrier fails to arrive on schedule resulting in unnecessary trips to the mail slot receptacle.

Furthermore, the subject device may be installed for residential or commercial use and, with regard to the latter, is particularly useful for businesses in the practice of responding to correspondence in a prompt manner. Occasionally, mail delivered through receptacles of this sort may go undetected for hours when an employee inadvertently neglects to check it. Delivered mail will then remain on the floor, uncollected, and often until it is too late to open and review in time for preparation of a same-day response.

An additional problem associated with owning or using a door-mounted mail receptacle is that unwanted deposits through the slot cannot be avoided without locking the swinging door which would also prevent legitimate deliveries. Moreover, mail slots provide an easy access to those who would invade an inhabitant's privacy by peering through the opening. These home security problems are greatly reduced by the subject invention by frightening off intruders when the alarm is activated and the inhabitant warned of potential improprieties.

Clearly, a significant need exists for a solution that addresses the shortcomings associated with mail slot receptacles. The subject invention completely eliminates these shortcomings by providing a means of immediately alerting the mail recipient each time the mail slot door is opened, thus providing home security and notice that a delivery has taken place.

SUMMARY OF THE INVENTION

The subject invention more specifically relates to an alarm apparatus capable of immediately alerting mail recipients of postal deliveries through a mail slot opening. The device is mounted adjacent the mail slot and comprises an activation lever, the distal end of which is in contact with the hinged, swinging door of the mail slot, and the proximal end of which is adapted with a contact switch retention means. As the door is opened, the activation lever rotates causing the retention means to release the contact switch resulting in the completion of a parallel circuit and the sounding of the alarm. The alarm may be a buzzer, beeper, radio or other suitable means of producing an audible alert which can be immediately detected. In another embodiment of the invention, completion of the circuit can activate a light for the hearing impaired. In still another embodiment of the invention, the subject device can be further adapted to trigger the activation of alarms at remote locations.

It is, therefore, a primary object of the subject invention to provide an alarm apparatus capable of immediately alerting mail recipients of postal deliveries through a mail slot opening such that unnecessary trips to check for mail may be avoided.

Another object of the subject invention is to provide a security alarm apparatus that alerts inhabitants of unwanted openings of mail slot doors.

It is also an object of the present invention to provide a mail slot alarm device simple in design and inexpensive to manufacture.

Other objects and advantages of the present invention will be apparent upon reference to the accompanying description when taken in conjunction with the following drawing.

DETAILED DESCRIPTION OF THE PREFERRED EMBODIMENT

Figure 1:
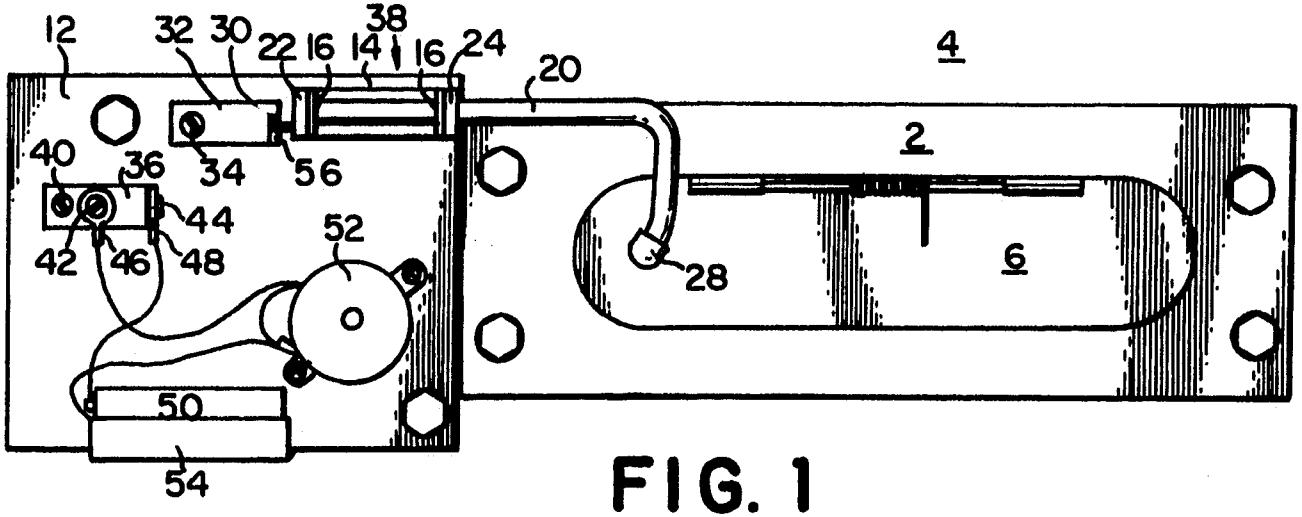
FIG. 1 is a diagrammatic illustration of the subject alarm device as installed adjacent a mail slot receptacle an in a "ready" mode.

Reference is now made to FIG. 1 in which there is illustrated in diagrammatic form the preferred embodiment of the subject alarm device installed adjacent to a mail receptacle identified, generally, by reference numeral 2. Mail receptacle 2 is typically mounted through an entry way door or surrounding structure 4 and comprises, in part, hinged door 6 which occupies mail slot 8 (FIG. 2) when door 6 is in the closed position.

The subject mail slot alarm device comprises a mounting plate 12 of steel or other suitable composition exhibiting excellent strength and electrical conductivity properties. A bracket 14 is mounted to the upper right-hand corner of mounting plate 12 by soldering or other means and is adapted with two apertures 16 of sufficient diameter to receive therethrough the proximal end of actuation lever 20. A pair of cylindrical fasteners 22 and 24 are fixedly attached to actuation lever 20 beside each arm of bracket 14 to prevent axial displacement of actuation lever 20.

The opposite end of actuation lever 20 is bent into an "L" configuration and abuts door 6. The distal end of actuation lever 20 is equipped with a plastic or rubber bumper 28 provided to reduce noise and friction between lever 20 and door 6 when the latter is opened.

Fastener 22 is further adapted with a pin 30 designed to support one end of contact switch arm 32 mounted to mounting plate 12 by pivot screw 34. Contact switch arm 32 is similarly of conductive steel or other such composition and is situated above terminal block 36, also mounted to mounting plate 12. Terminal block 36 is preferably of non-conductive wood composition and is fixedly mounted to mounting plate 12 by screw 40. Bracket 14, actuation lever 20, fasteners 22 and 24, pin 30, and contact switch 32 are collectively referred to as actuation assembly 38.

The bottom portion of mounting plate 12 is occupied by a conventional alarm assembly connected in series to terminal block 36 by screws 42 and 44 disposed through wire lugs 46 and 48, respectively. It should be understood that screw 42 is in contact with mounting plate 12 while screw 44 is not, therefore, a completed circuit requires that contact switch arm 32 engage screw 44.

The alarm assembly comprises a power source 50 and an alarm 52 in series circuit. In the preferred embodiment, power source 50 may be a 9 volt battery supported by cradle 54, and alarm 52 may be a beeper, buzzer, radio, light or other means capable of alerting an individual that door 6 has been opened. A cover (not shown) may also be attached to the apparatus to house its components for aesthetic purposes.

OPERATION

Figure 2:
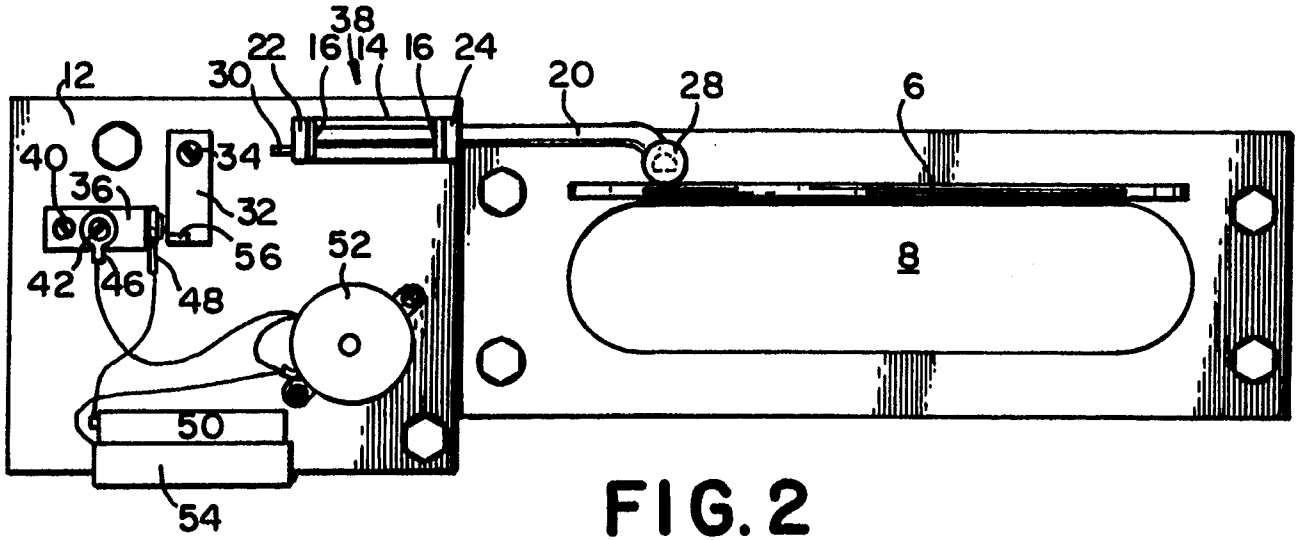
FIG. 2 is a diagrammatic illustration of the alarm device of FIG. 1, but in the "actuated" mode.

A comparison of FIGS. 1 and 2 reveals the simplicity of operation of the subject invention. Referring first to FIG. 1 it can be observed that the distal end of actuation lever 20 rests in the down position on door 6 of mail receptacle 2 which is in the closed position. This configuration is referred to as the "ready" mode. When door 6 is opened (FIG. 2), actuation lever 20 and fastener 22 are caused to rotate permitting pin 30 to disengage from slot 56 thereby releasing contact switch arm 32 which rotates freely to contact screw 44 thus completing the simple series circuit. This configuration is referred to as the "actuated" mode. The alarm sounds and will continue to do so until the mail recipient resets the device by lifting contact switch arm 32 and reinserting pin 30 into slot 56.

As indicated above, alarm 52 may be a radio which will be less offensive to the listener when the alarm is actuated for prolonged periods of time. Additionally, a bright light may be substituted for an audile alarm for the hearing impaired for easy visibility. Finally, the above described alarm apparatus may be connected to by conventional means (not shown) to audio or visual alarms in other locations of the dwelling place.

Thus it can be recognized that upon actuation of the subject mail slot alarm device, those occupying a commercial or residential building can instantly be alerted to the receipt of daily mail or the opening of the mail receptacle door for other, illegitimate purposes.

Although the present invention has been described with reference to the particular embodiments herein set forth, it is understood that the present disclosure has been made only by way of example and that numerous changes in details of construction may be resorted to without departing from the spirit and scope of the invention. Thus, the scope of the invention should not be limited by the foregoing specifications, but rather only by the scope of the claims appended hereto.

What is claimed is:

1. A mail slot alarm device, comprising:

(a) an electrically conductive mounting plate;

(b) a bracket mounted to said mounting plate;

(c) an actuation lever rotatably mounted through said bracket and secured by one or more fasteners such that axial displacement of said actuation lever is prevented;

(d) a contact switch pivotally mounted to said mounting plate;

(e) a pin connected to one of said one or more fasteners and capable of supporting said contact switch in an upright position; and (f) an alarm assembly, comprising a power source, an alarm and a terminal block in series circuit; said circuit being closed when said contact switch engages said terminal block.

2. In combination with a mail slot of the type wherein a receptacle is provided for the receipt of mail, said receptacle having a swinging door hingedly attached to the upper edge of said receptacle, and alarm device comprising:

(a) a mounting plate mounted adjacent to said receptacle;

(b) a bracket mounted to said mounting plate;

(c) an actuation lever rotatably mounted through said bracket and secured by one or more fasteners such that axial displacement of said actuation lever is prevented;

(d) a contact switch pivotally mounted to said mounting plate;

(e) a pin connected to one of said one or more fasteners and capable of supporting said contact switch in an upright position; and (f) an alarm assembly, comprising a power source, an alarm and a terminal block in series circuit, whereby said actuation lever is engaged by said door upon insertion of mail through said slot, said actuation lever causing said pin to release said contact switch and contact said terminal block to complete the circuit and activate said alarm.

3. The combination mail slot and alarm device of claim 2, wherein said actuation lever is engaged by said door upon inward movement of said door.

* * * * *